United States Patent [19]

Godijn

[11] Patent Number: 4,466,790

[45] Date of Patent: Aug. 21, 1984

[54] LIQUID-FUEL POT BURNER

[75] Inventor: Willem Godijn, Hilversum, Netherlands

[73] Assignee: Research Instituut Sesto B.V., Hilversum, Netherlands

[21] Appl. No.: 276,349

[22] PCT Filed: Oct. 10, 1980

[86] PCT No.: PCT/NL80/00032

§ 371 Date: Jun. 10, 1981

§ 102(e) Date: Jun. 10, 1981

[87] PCT Pub. No.: WO81/01043

PCT Pub. Date: Apr. 16, 1981

[30] Foreign Application Priority Data

Oct. 10, 1979 [NL] Netherlands ..... 7907496

[51] Int. Cl.[3] ..... F23D 5/04

[52] U.S. Cl. ..... 431/337; 431/333; 431/342; 431/341

[58] Field of Search ..... 431/196, 201, 331, 332, 431/333, 335, 336, 337, 338, 339, 340, 341, 342, 218; 126/95

[56] References Cited

U.S. PATENT DOCUMENTS

| | | | |
|---|---|---|---|
| 1,851,871 | 3/1932 | Salisbury | 431/201 X |
| 1,985,920 | 1/1935 | Elliot et al. | 431/200 X |
| 2,196,572 | 4/1940 | Whitehurst | 431/335 X |
| 2,219,349 | 10/1940 | Turner | 431/196 |
| 2,259,743 | 10/1941 | Fletcher | 431/340 X |
| 2,293,697 | 8/1942 | Chadwick | 431/339 |
| 2,409,677 | 10/1946 | Grotenhouse | 431/333 |
| 2,457,614 | 12/1948 | Tolley | 126/93 X |
| 2,501,396 | 3/1950 | Le Clerc et al. | 431/196 |
| 2,513,551 | 7/1950 | Custance | 431/335 |
| 2,518,132 | 8/1950 | Foster et al. | 126/96 |
| 2,549,067 | 4/1951 | Donley | 431/339 |
| 2,660,234 | 11/1953 | Nava | 431/339 X |
| 4,095,936 | 6/1978 | Godijn | 431/340 X |

FOREIGN PATENT DOCUMENTS

| | | | |
|---|---|---|---|
| 477892 | 1/1938 | France | 431/333 |
| 461687 | 10/1968 | Switzerland | 431/336 |

*Primary Examiner*—Larry Jones
*Assistant Examiner*—Carl Price
*Attorney, Agent, or Firm*—Diller, Ramik & Wight

[57] ABSTRACT

A pot burner, which in an undefined sloping position with rocking movements functions well, particularly in vehicles and vessels, because the vaporing surface of the fuel is defined and because the vapored fuel is well mixed with air in a first cage, which is enclosed by a second cage.

8 Claims, 4 Drawing Figures

Figure 4:
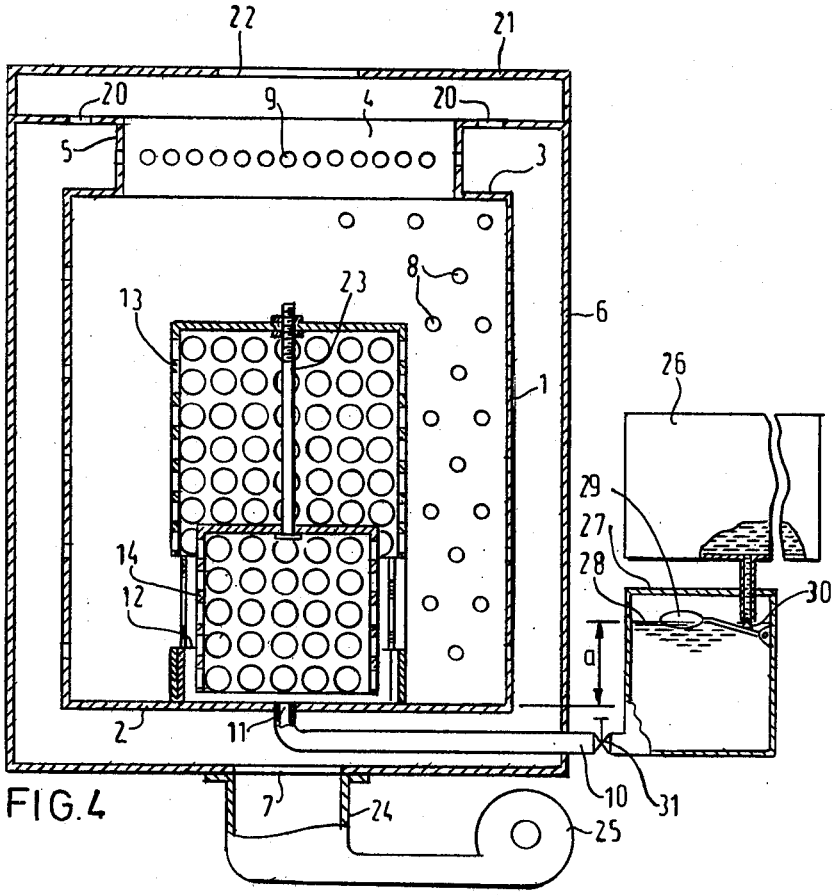

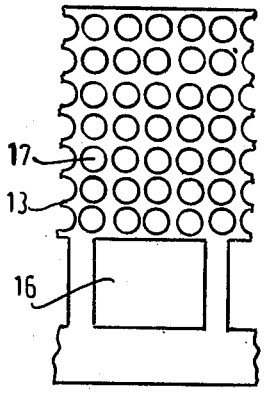
FIG. 2
FIG. 3
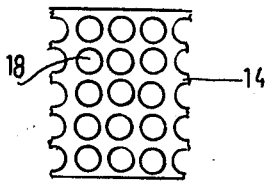
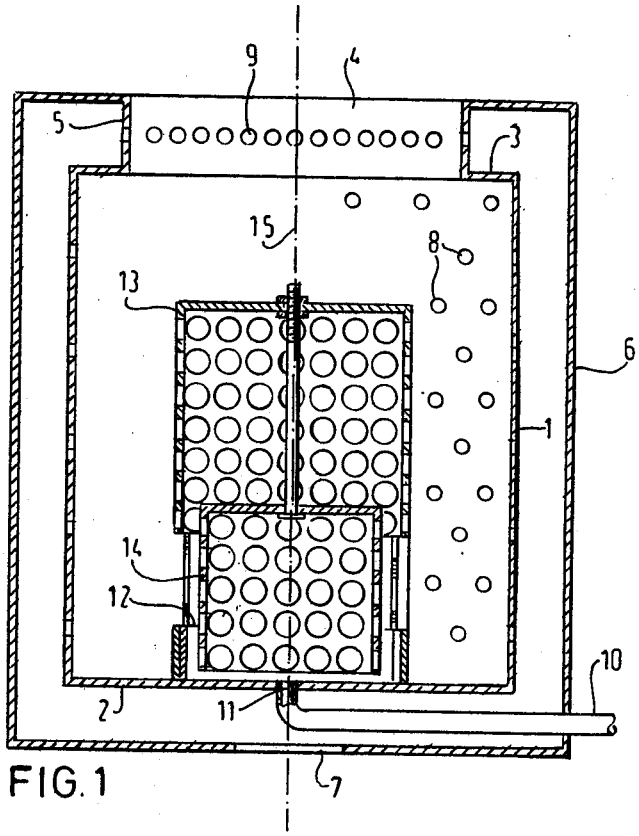
FIG. 1

LIQUID-FUEL POT BURNER

The invention relates to a pot burner for liquid fuel, comprising a single pot having at the top a flame orifice, the passage area of which is smaller than the passage area for fuel vapours in the pot, a jacket surrounding the pot, means for the supply of liquid fuel and means for the supply of primary and secondary air.

A pot burner of this type is used in general for heating small rooms. During operation liquid fuel is conveyed from a level-control through a supply duct to the pot bottom. The liquid fuel supplied is uniformly spread across the substantially horizontal pot bottom and gasified by the high temperature of the surface of the pot bottom. However, if such a pot burner is employed as a heating device for spaces in a vehicle or a vessel, the horizontal position of the pot bottom is not at all ensured due to rocking movements or to an inclined position of the vehicle or the vessel. In this case the distribution of the supplied liquid fuel across the pot bottom will not be uniform in different, desired control-positions of the level-control, which is inconvenient in that the gasification process is not satisfactorily performed, the flame becomes unsteady and the efficiency of the combustion is not at the optimum as a result of which soot is produced and the CO-contents of the combustion gases is high.

The invention has for its object to provide a pot burner of the kind set forth above, which due to certain provisions, is particularly suitable for use as a space heating device in vehicles, vessels or other objects subjected to rocking movements. A further object of the invention is to provide a very simple construction of the pot burner so that its manufacture can take place at low cost.

The pot burner according to the invention is characterized by a ring arranged concentrically with the pot wall and connected with the pot bottom for limiting the surface of the pot bottom to be wetted by liquid fuel, by an orifice arranged centrally in the pot bottom for the supply of liquid fuel, by a first inverted cage snugly embracing the outer surface of said ring and having a closed top wall and an apertured sidewall, by a second inverted cage arranged concentrically inside the first cage and having a closed top wall and an apertured sidewall, the lower side of which extends inside the space confined by the ring and the pot bottom without contacting the surface of the ring and the pot bottom, the distance between the lower edge of the sidewall of the second cage and the pot bottom being such as to ensure that under all operational conditions of the pot burner the gasification is maintained irrespective of deviations of the central axis of the pot burner from the vertical position occurring within given limits.

The invention will now be described more fully with reference to the following figures:

FIG. 1 is a diagrammatic, vertical sectional view of one embodiment of a pot burner constructed in accordance with the invention, FIG. 2 is an exploded view of part of the sidewall of the first inverted cage, FIG. 3 is an exploded view of part of the sidewall of the second, inverted cage, and FIG. 4 is a variant of a pot burner shown in FIG. 1.

As shown in FIG. 1, the pot of the burner comprises a cylindrical sidewall 1, a bottom 2, and a top wall 3 having a recess giving access to a flame orifice 4. The flame orifice 4 is bounded by an axially extending wall 5, which is at right angles to the top wall 3 of the pot.

The pot is surrounded by a jacket 6, which joins the top edge of the wall 5 of the flame orifice extending as far as beyond the pot bottom 2 and has, on the bottom side, an orifice 7 for the inlet of air forced in by means of a fan (not shown). The air sucked in is driven upwards in the space between the pot wall and the jacket and subsequently conducted away through apertures 8 dispersed along the height of the pot wall into the pot as primary air and respectively conducted away through apertures 9 in the wall 5 of the flame orifice 4 as secondary air.

In a conventional manner a duct 10 connected with a level-control (not shown) is provided for the supply of liquid fuel. The duct 10 is passed across the jacket 6 and opens into an opening 11 arranged centrally in the pot bottom 2.

Concentrically provided inside the pot is a ring 12 of, for example, sheet steel which is connected with the bottom 2. The ring 12 limits the surface of the pot bottom to be wetted by the liquid fuel and concentrates the gasification process inside the space enclosed by the ring. The outer surface of the ring 12 is snugly embraced by an inverted cage 13 having a closed top wall and a perforated side wall. Arranged concentrically inside the cage 13 is a second, inverted cage 14, the height of which is equal to about half the height of the cage 13. The second cage also has a top wall and a perforated sidewall. The cage 14 is held in place by giving supporting means (not shown) in a manner such that the lower side of the sidewall extending inside the space confined by the ring and the pot bottom without being in contact with the surface of he ring 12 and the pot bottom 2. The distance between the lower edge of the side wall of the second cage 14 and the pot bottom is such that under all operational conditions of the pot burner the gasification is maintained irrespective of deviations of the central axis 15 of the pot burner from the vertical position occurring within given limits.

The two cages 13 and 14 are made from refractory material, particularly sheet steel, FIGS. 2 and 3 are exploded views of part of the sidewall of the first cage 13 and part of the sidewall of the second cage 14, respectively. From FIG. 2 it will be apparent that the first cage 13 has near the lower side a row of apertures 16 of a first type, said apertures being substantially rectangular, above which a plurality of rows of apertures 17 of a second type are provided, which are substantially circular. The passage area of each aperture 16 of the first type is larger than that of each aperture 17 of the second type. When the first cage 13 is disposed around the ring 12, the rectangular apertures 16 are bounded on the one hand by the top edge of the ring, whilst said apertures extend in the sidewall of the first cage along a height which is smaller than the distance beween the top wall of the enclosed second cage 14 and the pot bottom 2. The comparatively large, rectangular apertures 16 serve to admit the combustion air unhindered into the second cage 14. The comparatively small apertures 18 of the second cage 14 are distributed throughout the entire sidewall thereof.

During operation the liquid fuel admitted is gasified on the part of the pot bottom inside the ring 12. Owing to the closed top walls of the two cages 13 and 14 the gas is driven sideways in order to raise the temperature of the cages to an optimum value. The freely arranged cage 14 attains a temperature (about 700° C.) which is appreciably higher than the temperature (about 380° C.) of the pot bottom 2. The hot internal cage 14 serves to maintain the gasification, even if the pot burner is exposed to rocking movements within given limits, that is to say even when the pot bottom moves out of its horizontal position, and due thereto the contact surface between the distributed liquid fuel and the pot bottom is reduced and the liquid fuel tends to flow through the rectangular apertures 16 across the upper edge of the ring 12. The combustion air admitted through the comparatively large apertures 16 in the external cage 13 into the internal cage 14 generates small flames on the sidewalls of the two cages at the comparatively small apertures. These flames are maintained on the sidewall of the internal cage 14 by the external cage 13 when the pot burner burns at higher capacity.

It has been found that diesel oil as a liquid fuel provides optimum results and that even in the case of rocking movements within given limits the pot burner shows a quiet flame shape and ensures complete combustion in all positions of the level regulator.

It will be obvious that within the scope of the invention various embodiments of the pot burner described above can be designed. The pot burner may, for example, have an oval shape rather than a cylindrical one.

The pot burner illustrated in FIG. 4 differs from the one shown in FIGS. 1–3 in that to increase the capacity of the pot burner a circular row of additional air apertures 20 is provided in the upper side of the jacket 6, whereas a cover or screen 21 is arranged there above, said cover having a central orifice 22, the passage of which is considerably smaller than that of the flame orifice 4.

FIG. 4 also shows that the cage 14 is suspended from the cage 13 by a central rod 23, the orifice 7 is connected by an air duct 24 to a blower 25 and the duct 10 receives fuel from a storage tank 26 through a float device 27, in which the liquid level 28 is maintained by means of a float 29 controlling a valve 30. The difference a in levels between the liquid level 28 and the pot bottom 2 is for instance 20 mm. The adjusted quantity of fuel is, at this difference in levels, controlled by a control valve 31 which influences the flow resistances of the fuel.

I claim:

1. A pot burner for liquid fuel, comprising a pot having a top, a depending pot wall and a pot bottom, said top including a flame orifice defining a top passage area which is smaller than the pot passage area for fuel vapours in the pot, a jacket surrounding the pot, means for the supply of primary and secondary air to said pot passage area, a ring arranged concentrically with the pot wall and connected with the pot bottom for limiting the surface of the pot bottom to be wetted by liquid fuel, an orifice arranged centrally in the pot bottom for the supply of liquid fuel, a first cage fixed to and adjoining the ring and having an apertured sidewall, a second cage arranged concentrically inside the first cage and having a closed, imperforate top wall and an apertured sidewall, the lower side of said second cage extending inside the space defined by the ring and the pot bottom, the first cage extending to a higher level than the second cage, the first cage having a closed, imperforate top wall, and the second cage being spaced from and arranged without being in contact with the surface of the ring and the pot bottom.

2. A pot burner as claimed in claim 1, wherein the sidewall of the first cage has a height which is about twice that of the second cage and has a row of apertures of a first type near the lower side and a plurality of rows of apertures of a second type located above the former, the passage area of each aperture of the first type being larger than that of each aperture of the second type.

3. A pot burner as claimed in claim 2, wherein the apertures of the first type of the first cage are substantially rectangular, are bounded on the one hand by the top edge of the ring and extend in the sidewall of the first cage along a height which is smaller than the distance between the top wall of the enclosed second cage and the pot bottom.

4. A pot burner as claimed in claim 1, 2 or 3 wherein the apertures of the second cage are provided throughout the entire sidewall thereof.

5. A pot burner as claimed in claim 1, 2, or 3 wherein a cover is arranged above the flame orifice, said cover having a central opening above the flame orifice, which central opening has a considerably smaller passage area than the flame orifice, and additional air apertures are provided for the supply of additional air to the space contained beneath the cover.

6. A pot burner as claimed in claim 4 wherein a cover is arranged above the flame orifice, said cover having a central opening above the flame orifice, which central opening has a considerably smaller passage area than the flame orifice, and additional air apertures are provided for the supply of additional air to the space contained beneath the cover.

7. A pot burner for liquid fuel comprising, in combination:

a pot having a bottom wall and an upstanding perforate side wall;

means upstanding from a small central portion of said bottom wall for defining a fuel bowl and inlet means for supplying liquid fuel to said fuel bowl;

a jacket having a side wall surrounding and spaced radially outwardly from said perforate side wall of the pot to define an air chamber, said pot and said jacket defining a restricted flame orifice above said fuel bowl and including secondary air passage means communicating said flame orifice with said air chamber, said jacket having air inlet means for supplying pressurized air to said air chamber whereby primary combustion air is forced to flow through said perforate side wall of the pot and secondary combustion air is forced to flow through said secondary air passage means; and means for causing liquid fuel in said bowl to be gasified in said bowl and comprising inner cage means for causing the liquid fuel to gasify in said bowl and outer cage means for maintaining said inner cage means at a sufficiently high temperature as to assure said liquid fuel to gasify in said bowl, said inner cage means having a top wall and a depending, perforate side wall presenting a lower edge projecting into the confines of said bowl in inwardly spaced relation thereto and being spaced above said bottom wall of the pot, said outer cage means having a top wall spaced below said flame orifice and above the top wall of the inner cage means and a depending, perforate side wall surrounding at least the upper portion of the side wall of said inner cage means, said side wall of the pot and said means for causing liquid fuel in said bowl to be gasified in said bowl defining an inner air chamber into which combustion air flows through said perforate side wall of the pot from said air chamber, the top walls of said inner and outer cage means being imperforate whereby gasified fuel from said bowl is caused to flow radially outwardly through said perforate side walls of the inner and outer cage means essentially countercurrent to the flow of primary combustion air whereby to generate small flames on said side walls of the inner and outer cage means at the perforations thereof, said outer cage means presenting large primary air passage means to admit primary combustion air essentially unhindered into said inner cage means.

8. A pot burner for liquid fuel comprising, in combination:

a pot having a bottom wall and an upstanding perforate side wall;

means upstanding from a small central portion of said bottom wall for defining a fuel bowl and inlet means for supplying liquid fuel to said fuel bowl;

a jacket having a side wall surrounding and spaced radially outwardly from said perforate side wall of the pot to define an air chamber, said pot and said jacket defining a restricted flame orifice above said fuel bowl and including secondary air passage means communicating said flame orifice with said air chamber, said jacket having air inlet means for supplying pressurized air to said air chamber whereby primary combustion air is forced to flow through said perforate side wall of the pot and secondary combustion air is forced to flow through said secondary air passage means; and means for causing liquid fuel in said bowl to be gasified in said bowl and comprising inner cage means for causing the liquid fuel to gasify in said bowl and outer cage means for maintaining said inner cage means at a sufficiently high temperature as to assure said liquid fuel to gasify in said bowl, said inner cage means having a top wall and a depending, perforate side wall presenting a lower edge projecting into the confines of said bowl in inwardly spaced relation thereto and being spaced above said bottom wall of the pot, said outer cage means having a top wall spaced below said flame orifice and above the top wall of the inner cage means and a depending, perforate side wall surrounding at least the upper portion of the side wall of said inner cage means, said side wall of the pot and said means for causing liquid fuel in said bowl to be gasified in said bowl defining an inner air chamber into which combustion air flows through said perforate side wall of the pot from said air chamber, the top walls of said inner and outer cage means being imperforate.

* * * * *